US005893604A

United States Patent [19]

Yao

[11] Patent Number: 5,893,604

[45] Date of Patent: Apr. 13, 1999

[54] STOOL

[76] Inventor: Miao Fang Yao, P.O. Box 82-144, Taipei, Taiwan

[21] Appl. No.: 09/071,984

[22] Filed: May 5, 1998

[51] Int. Cl.[6] ..... A47C 9/00

[52] U.S. Cl. ..... 297/16.1; 108/118; 297/461

[58] Field of Search ..... 297/16.1, 51, 56, 297/461; 248/150, 166; 108/118–120, 131

[56] References Cited

U.S. PATENT DOCUMENTS 2,996,278 8/1961 Ioris ..... 108/119 X
5,478,138 12/1995 Yu ..... 297/16.1 X

FOREIGN PATENT DOCUMENTS 8401170 5/1985 Netherlands ..... 297/56
6181 3/1899 United Kingdom ..... 108/118

*Primary Examiner*—Peter R. Brown
*Attorney, Agent, or Firm*—A & J

[57] ABSTRACT

A stool includes a seat, a primary U-shaped frame having a lower portion provided with a transverse rod, a secondary H-shaped frame pivotally connected with the primary U-shaped frame at an intermediate portion thereof, a U-shaped positioner pivotally connected to upper ends of the secondary frame, and a pair of elongated stays fixedly mounted on a bottom of the seat and provided with a primary recess dimensioned to receive an upper end of the primary frame and a secondary recess dimensioned to receive a horizontal portion of the U-shaped positioner, whereby the stool can be conveniently collapsed when not in use.

1 Claim, 4 Drawing Sheets

STOOL

BACKGROUND OF THE INVENTION

1. Field of the Invention

This invention is related to an improved stool and in particular to one which can be conveniently collapsed when not in use.

2. Description of the Prior Art

Referring to FIG. 1, the conventional stool for bar counters generally includes a base A, a post B, a seat C and a foot rest D.

As shown, the base A is a circular disk on the center of which is vertically mounted the post B. The seat C is arranged on the upper end of the post B, while the foot rest D is mounted on an appropriate position of the post B. However, such a stool suffers from the following drawbacks:

1. The stool cannot be folded thereby making it very inconvenient to transport and difficult to stow when not in use and therefore making it unfit for practical use.

2. The base of the stool is heavy and has a large area in order to increase its stability thus making it very difficult to move.

Therefore, it is an object of the present invention to provide an improved stool which can obviate and mitigate the above-mentioned drawbacks.

SUMMARY OF THE INVENTION

This invention is related to an improved stool for bar counters.

It is the primary object of the present invention to provide a stool which can be conveniently collapsed when not in use.

It is another object of the present invention to provide a stool which is stable in use.

It is still another object of the present invention to provide a stool which is simple in construction.

It is still another object of the present invention to provide a stool which is low in cost.

It is a further object of the present invention to provide a stool which is facile to stow and transport.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
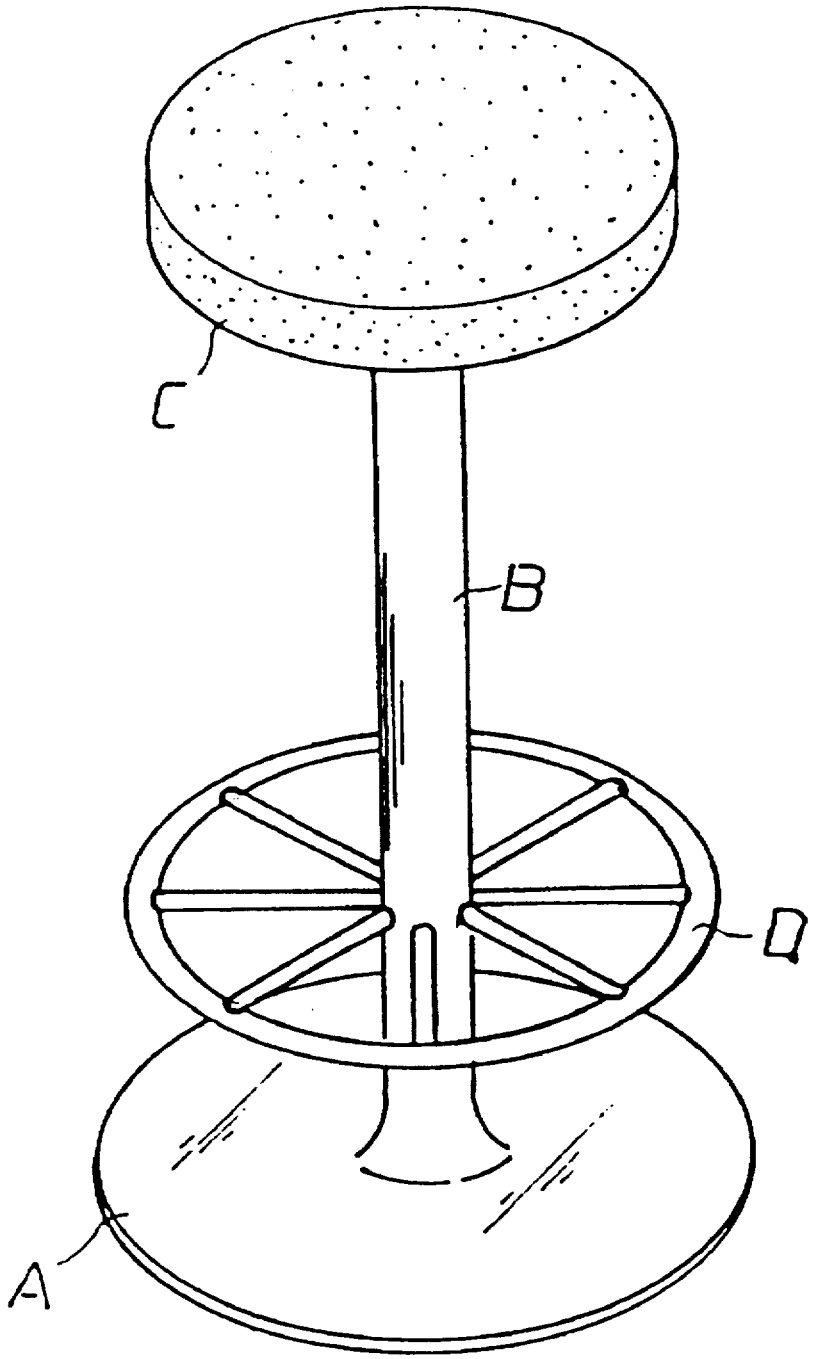
PRIOR ART FIG. 1
FIG. 1 is a perspective view of a prior art stool adapted for use in a bar counter.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
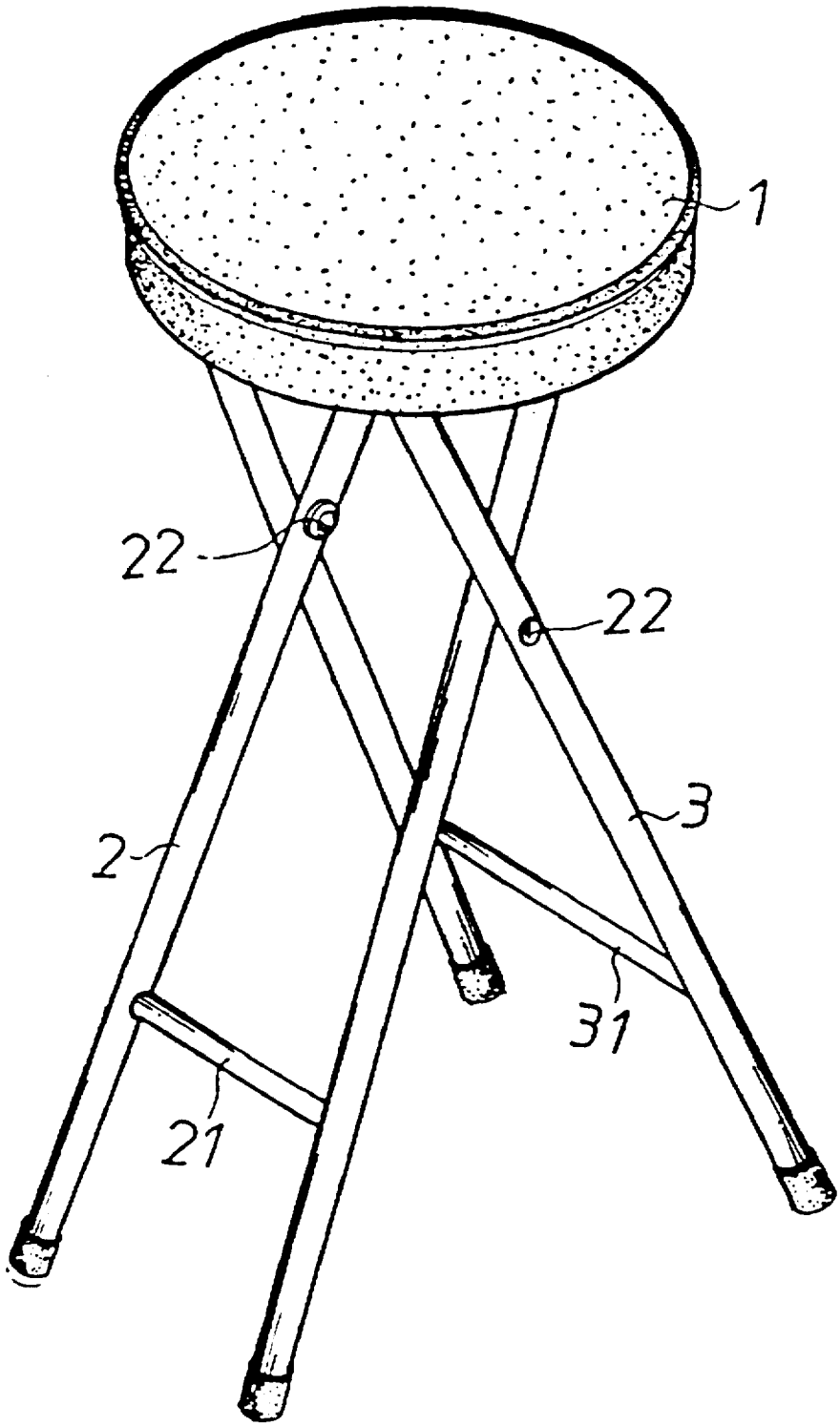
FIG. 2 is a perspective view of a stool according to the present invention.
Figure 3:
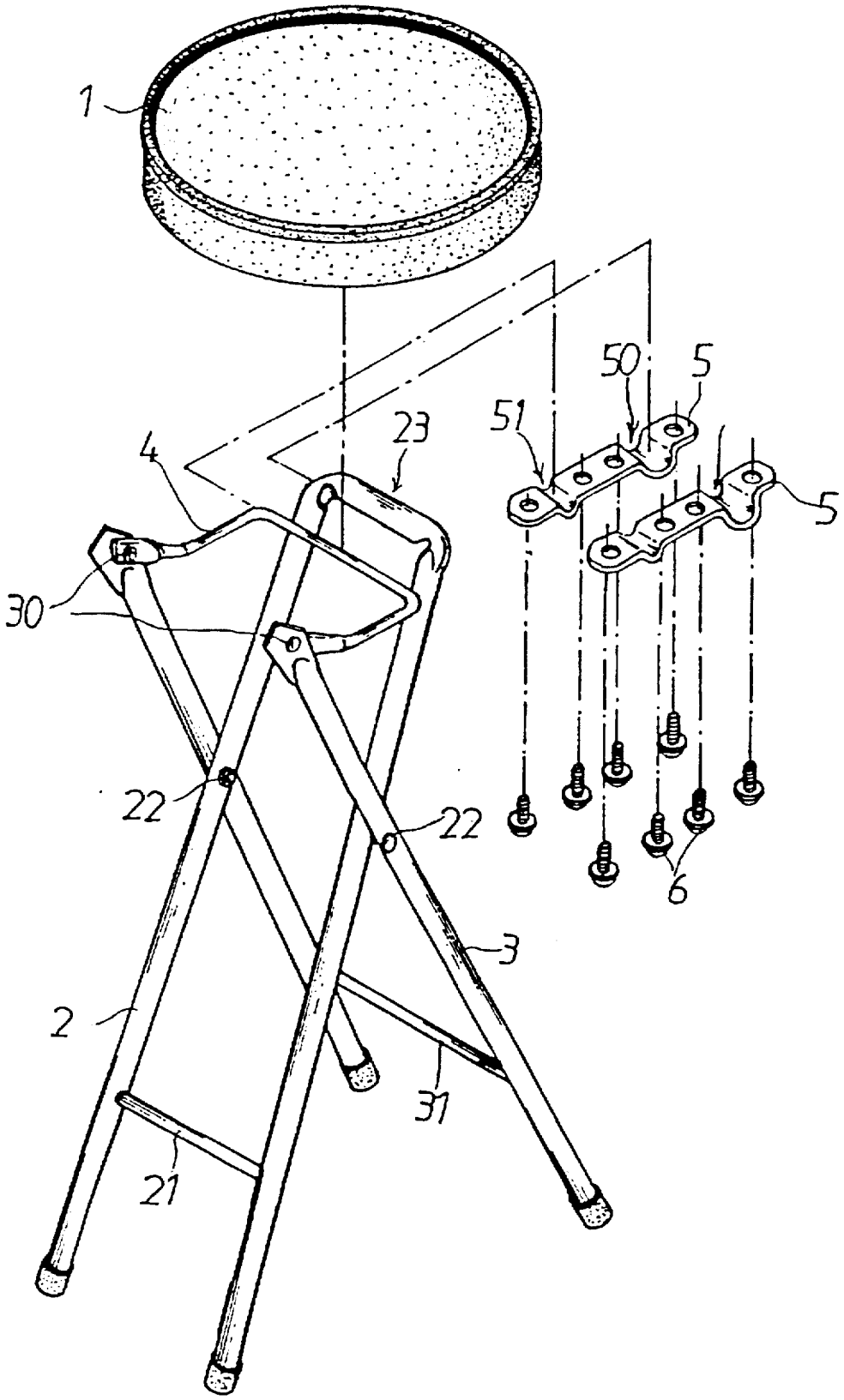
FIG. 3 is an exploded view of the stool.

With reference to the drawings and in particular to FIGS. 2 and 3 thereof, the stool according to the present invention generally comprises a seat 1, a primary frame 2, a secondary frame 3, a U-shaped positioner 4 and two elongated stays 5.

The primary frame 2 is an inverted U-shaped member having an open bottom and provided with a transverse rod 21 close to the open bottom.

The secondary frame 3 is a H-shaped member provided with a transverse rod 31 at the lower portion. The secondary frame 3 is pivotally connected with the primary frame 2 by two rivets 22 so that the two frames 2 and 3 may be rotated about the rivets 22 to form a X-shaped member.

The U-shaped positioner 4 is pivotally connected to the upper end of the secondary frame 3 by rivets 30.

Each of the elongated stays 5 is formed with a primary recess 50 dimensioned to receive an upper end 23 of the primary frame 2 and a secondary recess 51 dimensioned to receive the transverse portion of the U-shaped positioner 4. The two elongated stays 5 are fixedly mounted in parallel on the bottom of the seat 1 by screws 6 so that the upper end 23 of the primary frame 2 and the U-shaped positioner 4 can be rotated with respect to the stays 5.

In assembly, the stays 5 are fixedly mounted on the bottom of the seat 1 by screws 6 so that the upper end 23 of the primary frame 2 and the transverse portion of the U-shaped positioner 4 are received in the primary and secondary recesses 50 and 51 respectively. Then, the U-shaped positioner 4 is pivotally connected with the upper ends of the secondary frame 3 by rivets 30 and the secondary frame 3 is pivotally connected to the primary frame 2 by rivets 22 thereby forming a collapsible stool.

Figure 4:
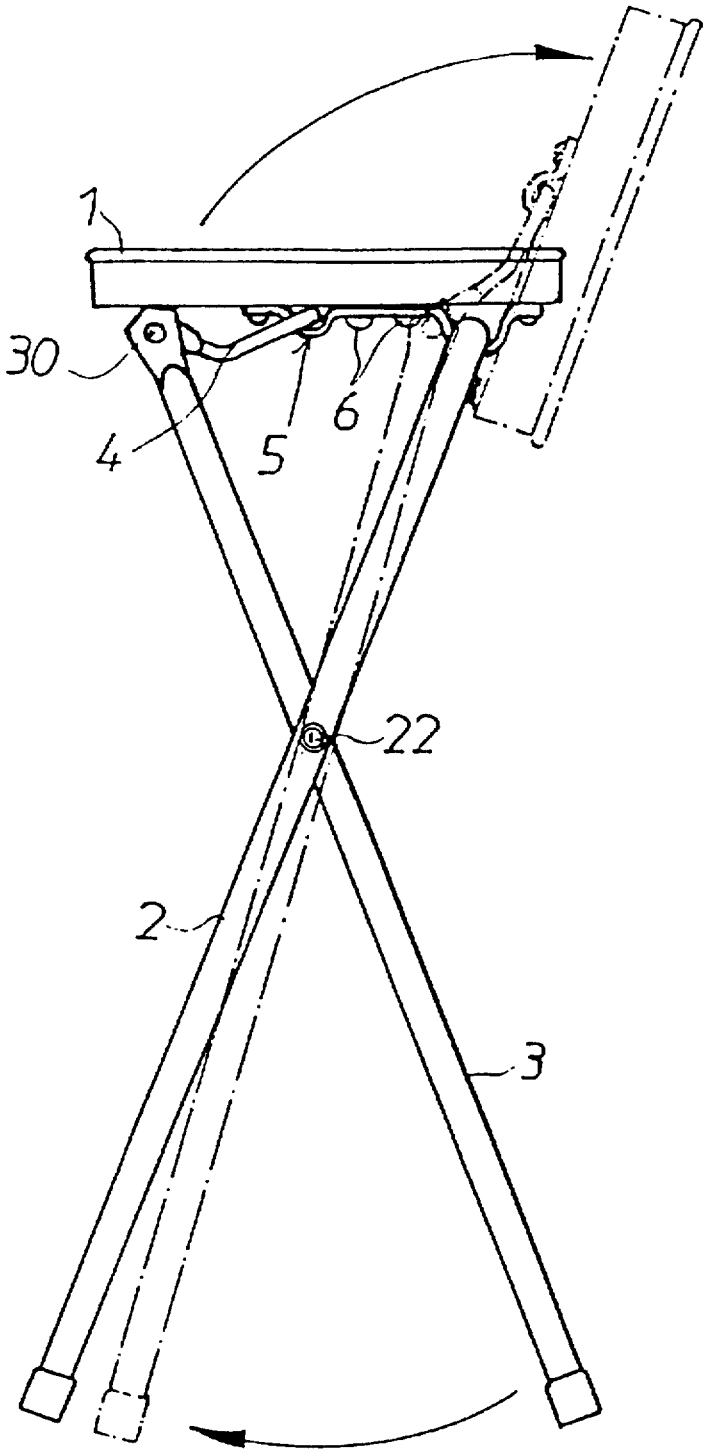
FIG. 4 illustrates the working principle of the present invention.

When in use, it is only necessary to turn the primary and secondary frames 2 and 3 in opposite directions with respect to the rivets 22. The angle between the primary and secondary frames 2 and 3 is limited by the U-shaped positioner 4 (see FIG. 4).

When not in use, simply turn the seat 1 upwardly to collapse the stool. As the seat 1 is turned upwardly, the seat 1 will be rotated with respect to the upper end 23 of the primary frame 2 while the U-shaped positioner 4 is pulled to rotate the secondary frame 3 with respect to the rivets 22 thereby folding the stool.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A stool comprising:

a seat;

a primary U-shaped frame having a lower portion provided with a transverse rod;

a secondary H-shaped frame pivotally connected with said primary U-shaped frame at an intermediate portion thereof;

a U-shaped positioner pivotally connected to upper ends of said secondary frame; and a pair of elongated stays fixedly mounted on a bottom of said seat and provided with a primary recess dimensioned to receive an upper end of said primary frame and a secondary recess dimensioned to receive a horizontal portion of said U-shaped positioner.

* * * * *